US005636410A

United States Patent [19]

Chou

[11] Patent Number: 5,636,410

[45] Date of Patent: Jun. 10, 1997

[54] RETRACTABLE HANDLE ASSEMBLY FOR A SUITCASE

[76] Inventor: Cheng-Tsan Chou, 27, Lane 280, Chung Zhen Road, Sa Lu, Taichung Shien, Taiwan

[21] Appl. No.: 637,319

[22] Filed: Apr. 9, 1996

[51] Int. Cl.[6] ..... B25G 1/04

[52] U.S. Cl. ..... 16/115; 190/18 A; 280/47.371

[58] Field of Search ..... 16/115, 112; 280/37, 280/47.315, 47.371, 655, 655.1; 190/14, 15 R, 18 A, 18 R, 104

[56] References Cited

U.S. PATENT DOCUMENTS

| | | | |
|---|---|---|---|
| 5,379,486 | 1/1995 | Wang | 16/115 |
| 5,499,702 | 3/1996 | Wang | 190/18 A |
| 5,502,876 | 4/1996 | Wang | 280/655 |

*Primary Examiner*—Chuck Y. Mah

*Attorney, Agent, or Firm*—Peterson, Wicks, Nemer & Kamrath, P.A.

[57] ABSTRACT

A retractable handle assembly for a suitcase and includes a handlebar which has a bar disposed to a top thereof with a spring disposed therebetween, two connecting elements each having one end thereof fixedly to the bar and the other end extending through the handlebar, two second tubes each having one end fixedly to a base in the suitcase and having a plurality of fifth holes defined in an inner side thereof, two first tubes respectively retractably received in the first tube corresponding thereto, a first end of each of the first tubes fixedly to the handlebar and the connecting element received in the first tube corresponding thereto wherein the second end of the connecting element having two bosses extending therefrom and a slot defined between the two bosses, the second end of each of the first tube having a lower hole defined in an inner side thereof and a locking member urgedly extending through the slot, the lower hole of the first tube and one of the fifth holes of the second tube by a resilient element disposed in the first tube, the locking member being lifted from the fifth hole by the bosses moved below a head of the locking member by pushing the handlebar downwardly.

1 Claim, 5 Drawing Sheets

RETRACTABLE HANDLE ASSEMBLY FOR A SUITCASE

BACKGROUND OF THE INVENTION

1. Field of the Invention

The present invention relates to a retractable handle assembly and more particularly, to a retractable handle assembly for a suitcase, which can be easily operated with one handle and has a simple structure.

2. Brief Description of the Prior Art

With the increasing number of travelers and the shortage of porters, bellhops and the like attendants to assist with carrying luggage in airport, railroad station, hotels and motels, it is becoming increasingly important to provide hand luggage with means for conveniently rolling or sliding the luggage over the supporting surface, while at the same time manner whenever desired. One example of handle structure meeting the foregoing requirements is shown in U.S. Pat. No. 4,358,005 to Giampiero Fontana, filed Nov. 5, 1980. However, Fontana's invention has a complicated structure which increases manufacturing cost and is difficult to be maintained when the complicated structure is damaged.

The present invention intends to provide a retractable handle assembly which is operated by first pushing a handlebar and then pulling two first tubes received in two second tubes of the suitcase, the assembly has a simple structure and is easily to be operated so as to mitigate and/or obviate the above-mentioned problems.

SUMMARY OF THE INVENTION

The present invention provides a retractable handle assembly for a suitcase and includes a handlebar which has a bar disposed to a top thereof with a spring disposed therebetween. Two connecting elements each have one end thereof fixedly to the bar and the other end extends through the handlebar. Two second tubes each have one end fixedly to a base in the suitcase and have a plurality of fifth holes defined in an inner side thereof. Two first tubes are respectively retractably received in the first tube corresponding thereto, a first end of each of the first tubes fixedly to the handlebar and the connecting element received in the first tube corresponding thereto wherein the second end of the connecting element having two bosses extending therefrom and a slot defined between the two bosses. The second end of each of the first tubes has a lower hole defined in an inner side thereof and a locking member urgedly extends through the slot, the lower hole of the first tube and one of the fifth holes of the second tube by a resilient element disposed in the first tube. The locking member is lifted from the fifth hole by the bosses moved below a head of the locking member by pushing the handlebar downwardly.

It is an object of the present invention to provide a retractable handle assembly for a suitcase with a simple structure.

It is another object of the present invention to provide a retractable handle assembly which is easy to be operated.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
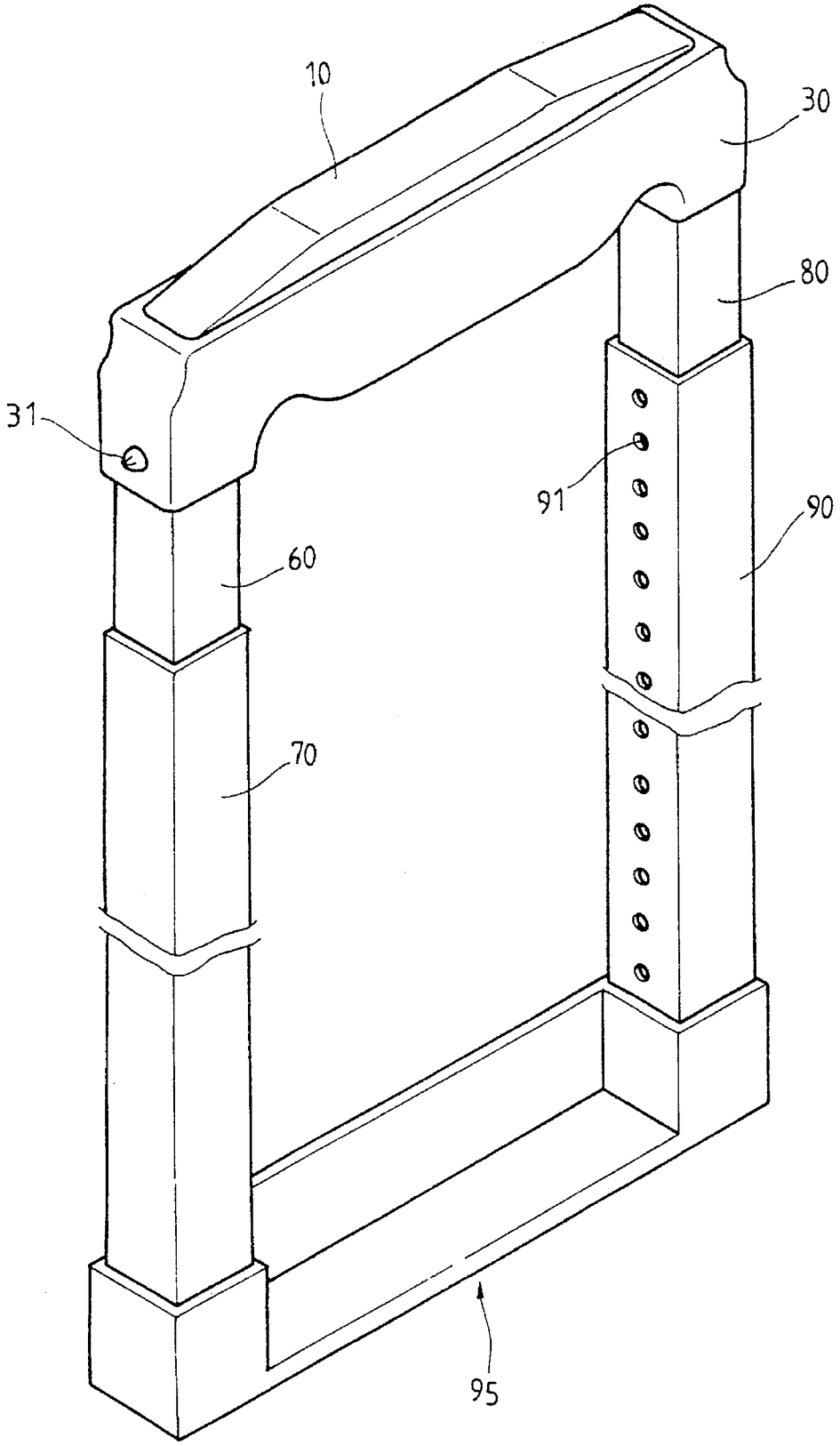
FIG. 1 is a perspective view of a retractable handle assembly in accordance with the present invention.
Figure 2:
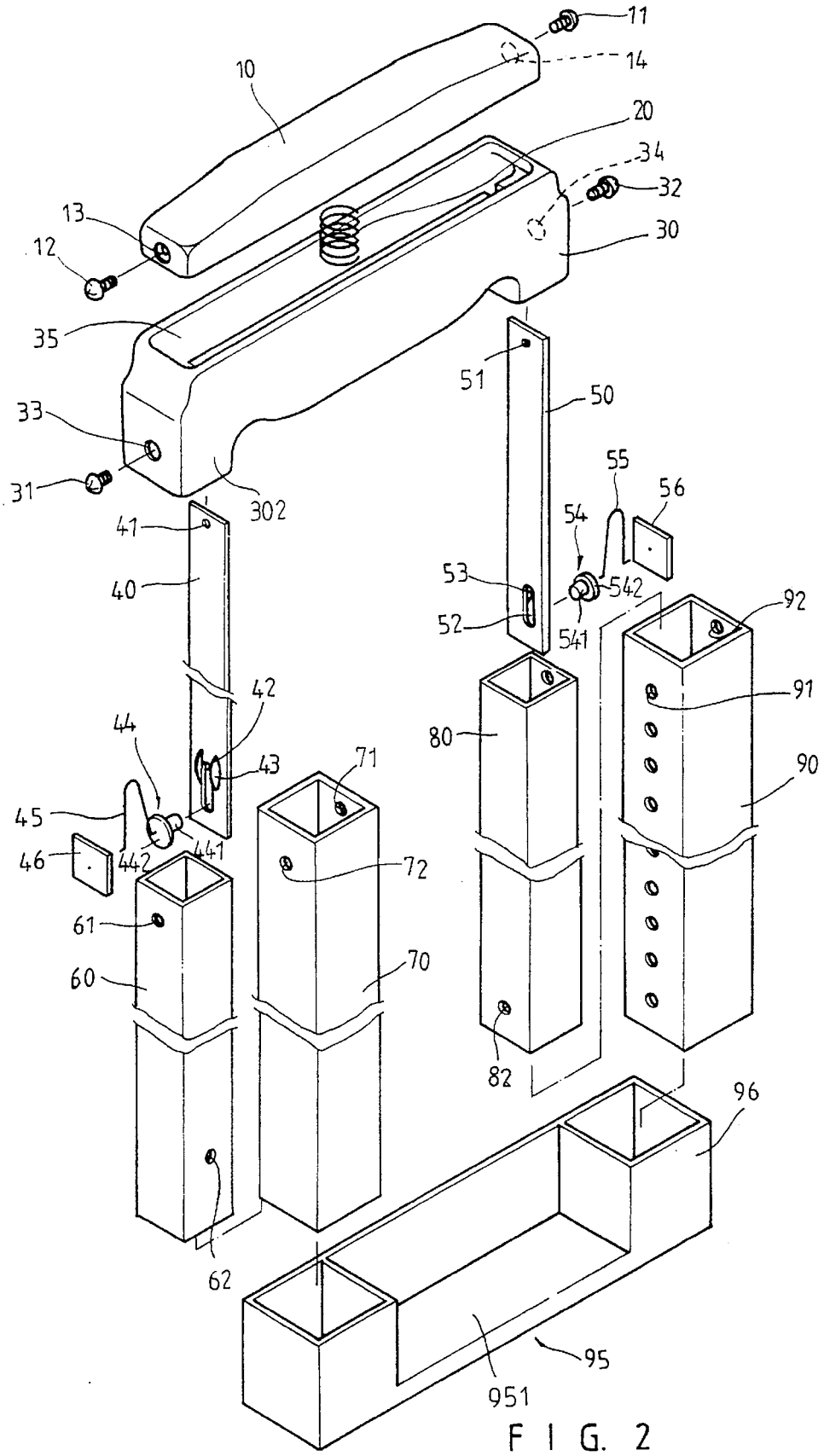
FIG. 2 is an exploded view of the handle assembly in accordance with the present invention.
Figure 3:
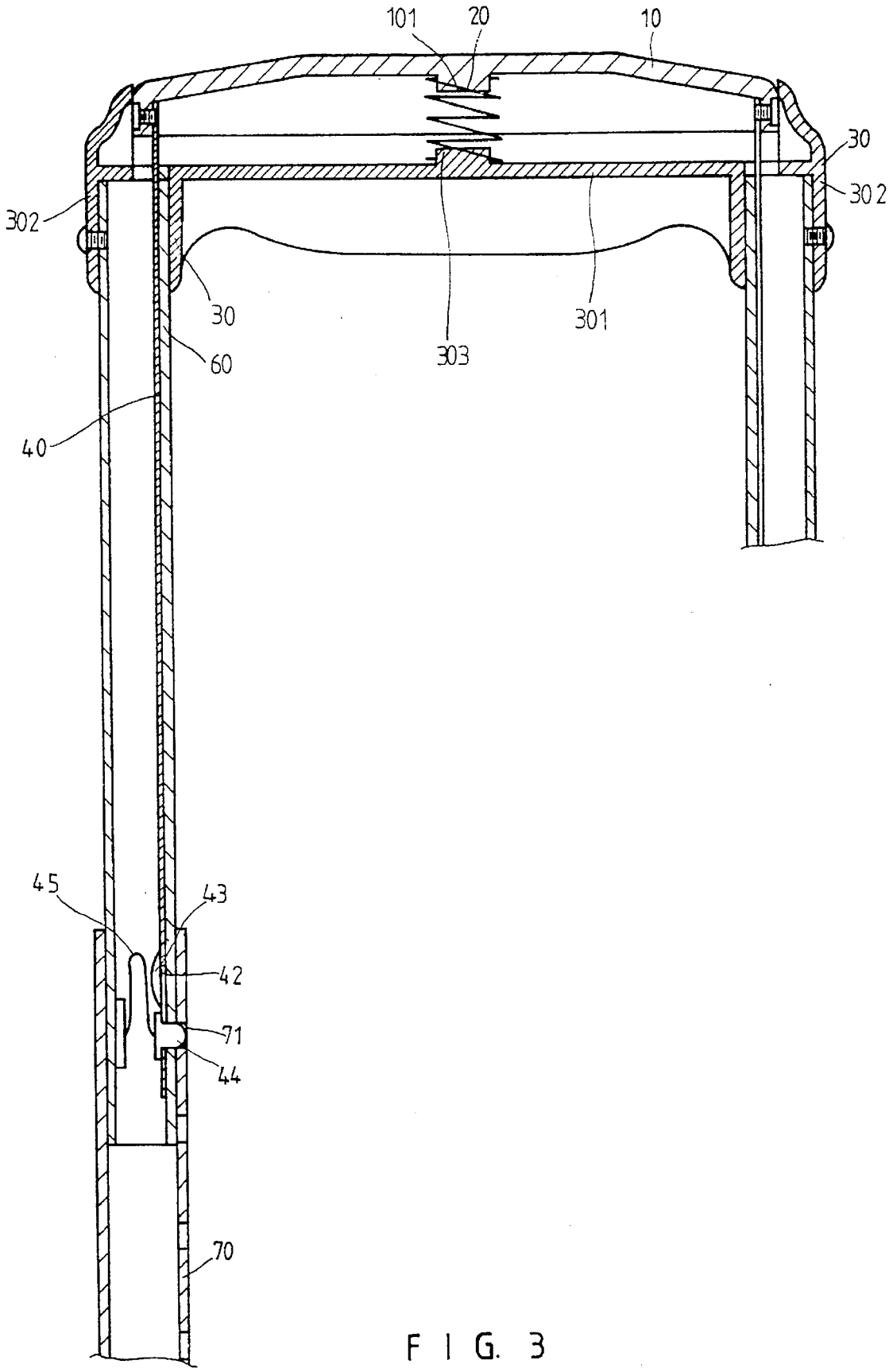
FIG. 3 is a side elevational view, partly in section, of the handle assembly wherein the locking member is inserted into a fifth hole of the second tube.

Referring to the drawings and initially to FIGS. 1 through 3, a retractable handle assembly in accordance with the present invention generally includes a handlebar 30 being an elongated element and having an elongated recess 35 defined in a top thereof, a bottom 301 disposed in the handlebar 30 and the bottom defining the recess 35. A tubular portion 302 extending from an under side of each one of two ends of the handlebar 30, each of the tubular portions 302 having a first hole 33/34 defined in an outer surface thereof. The bottom 301 has a first stud 303 extending upwardly from an upper surface thereof and has two second holes 304 defined therein, each one of the second holes 304 respectively communicating with the tubular portion 302 corresponding thereto.

A bar 10 has a second stud 101 extending from an under side thereof and has a side wall extending downwardly from each one of two ends thereof, each of the side wall having a third hole 13/14 defined therein. The bar 10 is configured to be received in the recess 35 of the handlebar 30 and a resilient element 20 is urged between the first stud 303 and the second stud 101.

Two connecting elements 40, 50 each have a first end and a second end, the first end thereof having a fourth hole 41/51 defined therein and being inserted through the second hole 304 from the under side of the tubular portion 302 corresponding thereto. The first end of the connecting element 40/50 is fixedly disposed to the corresponding side wall of the bar 10 by extending a first screw 11/12 through the third hole 13/14 and the fourth hole 41/51, the second end of the connecting element 40/50 having a slot 42/52 defined longitudinally therein and two bosses 43/53 extending from the connecting element 40/50 between which the slot 42/52 is defined.

Two first tubes 60, 80 each have a first end and a second end, and comprise an outer side and an inner side, an upper hole 61/81 defined in the outer side of the first end of the first tube 60/80 and a lower hole 62/82 defined in the inner side of the second end of the first tube 60/80. Each of the first tubes 60, 80 receives the connecting element 40/50 corresponding thereto and each of the first tubes 60, 80 is fixedly connected to the tubular portion 302 corresponding thereto by extending a second screw 31/32 through the first hole 33/34 of the tubular portion 302 and the upper hole 61/81 of the first tube 60/80.

Two second tubes 70, 90 each have a first end and a second end, and comprise an outer side and an inner side, a plurality of fifth holes 71/91 defined longitudinally along the inner side of each of the second tubes 70/90 and a locking hole 72/92 defined in the outer side of the first end of each of the two second tubes 70, 90. The second end of each one of the first tubes 60/80 is inserted into the second tube 70/90 corresponding thereto.

A base 95 has a bottom 951 and a receiving portion 96 extends from each one of two ends of the bottom 951 of the base 95, the second end of each of the second tubes 70/90 being fixedly received in the receiving portion 96 corresponding thereto by any well-known manner.

Figure 4:
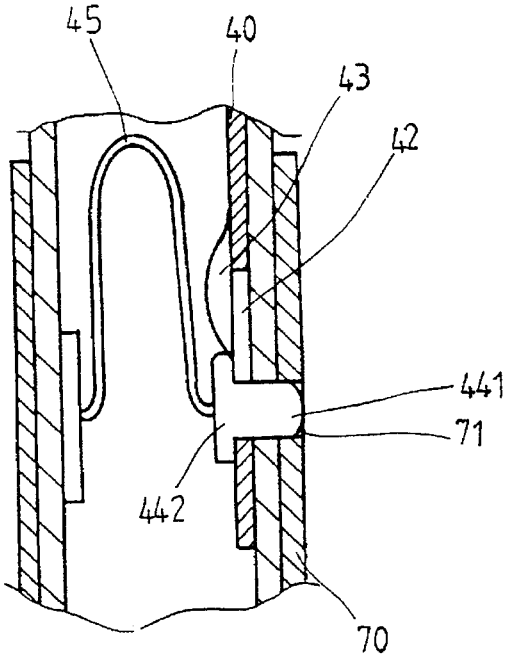
FIG. 4 is an enlarged fragmentary, partially sectional side view corresponding to FIG. 3 and shows the arrangement of the bosses and the head of the locking member.

Two locking members 44/54 each have a shank 441/541 and a head 442/542 which extends radially from one end of the shank 441/541. The shank 441/541 is inserted through the lower hole 62/82 of the corresponding first tube 60/80 and one of the locking hole 71/91 of the corresponding second tube 70/90. Two resilient elements 45/55 each of which is disposed in the first tube 60/80 corresponding thereto and the resilient element 45/55 has a first end and a second end, the first end thereof fixedly disposed in an inner surface of the outer side of the first tube 60/80 and the second end thereof urged to be fixed to the head 442/542. When the handlebar 30 is in a lowest locked position, the shank 441/541 extending through the slot 42/52, the lower hole 62 of the first tube 60/80 and the lowest fifth hole 71/91 of the second tube 70/90. When in use, a user (not shown) the user grasps the bar 10 and the handlebar 30 to push the bar 10 downwardly toward to the locking member 44/54, each one of the locking members 44/54 being lifted out from the locking hole 71/91 by the bosses 43/53 being moved below the head 442/542 of the locking member 44/54 corresponding thereto, therefore, the first tubes 60, 80 are retracted with the handlebar 30 from the second tubes 70/90 till the shank 441/541 inserted into another fifth hole 71/91 at a desired height as show in FIGS. 3, 4.

Figure 6:
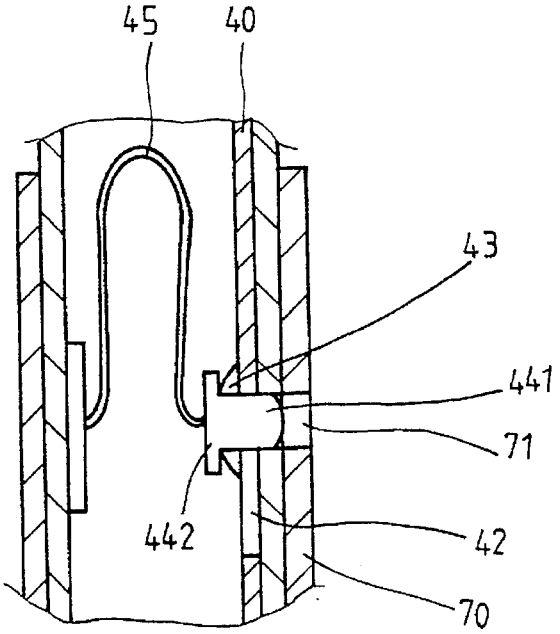
FIG. 6 is an enlarged fragmentary, partially sectional side view corresponding to FIG. 5 and shows the arrangement of the bosses moved below the head of the locking member.
Figure 5:
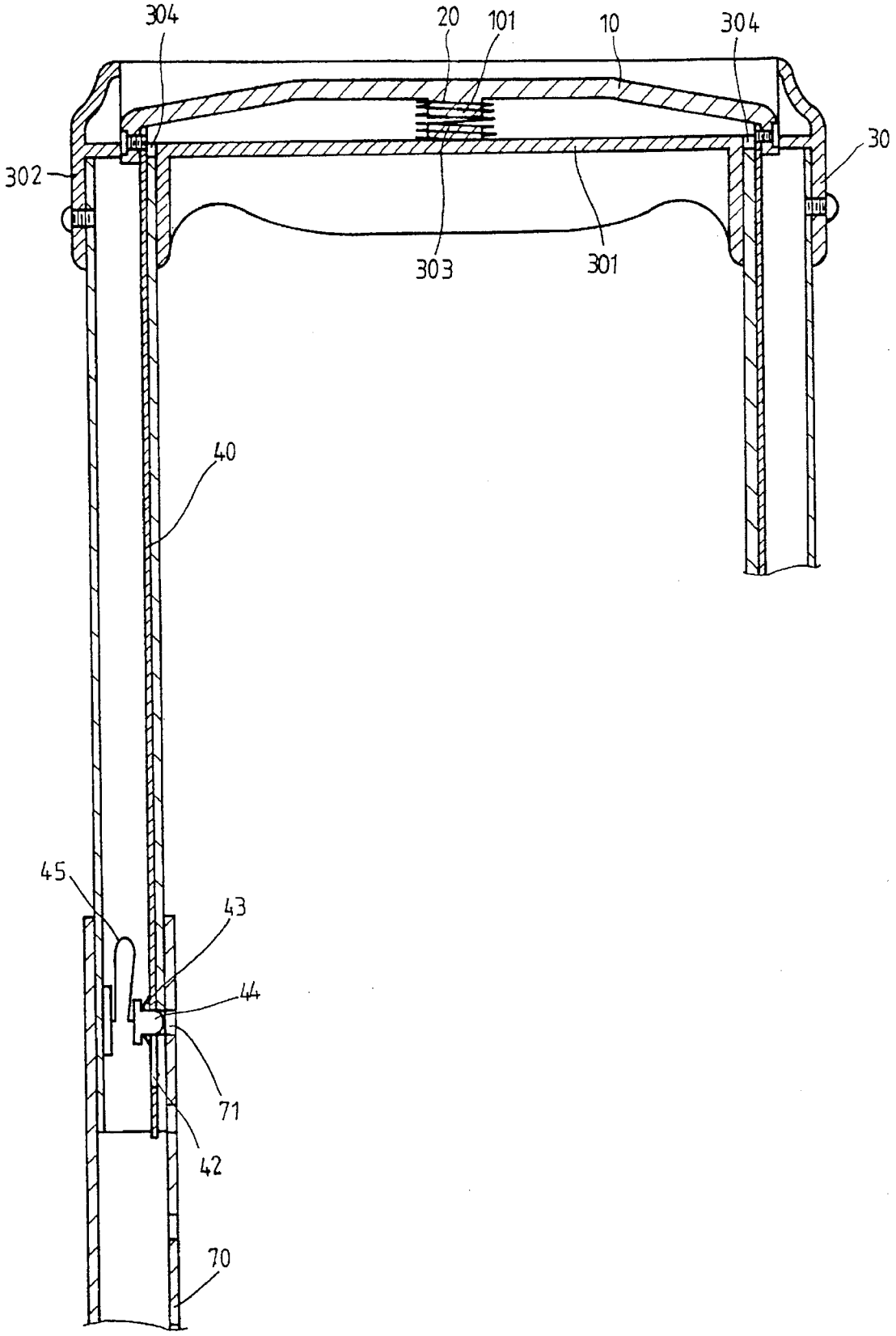
FIG. 5 is a side elevational view, partly in section, of the handle assembly wherein the locking member is lifted from the fifth hole by moving two bosses of the connecting element below the head of the locking member.

Referring to FIGS. 5 and 6, when the user wants to push the handlebar 30 downwardly, he or she simply repeats the action processes above which is to grasp the bar 10 and the handlebar 30 and pushes the bar 10 downwardly toward to the locking member 44/54, each one of the locking members 44/54 will be lifted out from the locking hole 71/91 by the bosses 43/53 being moved below the head 442/542 of the locking member 44/54 corresponding thereto such that the handlebar 30 together with the first tubes 60/80 can be pushed downwardly.

Although the invention has been explained in relation to its preferred embodiment, it is to be understood that many other possible modifications and variations can be made without departing from the spirit and scope of the invention as hereinafter claimed.

What is claimed is:

1. A retractable handle assembly for a suitcase and comprising:

a handlebar being an elongated element and having an elongated recess defined in a top thereof, a bottom disposed in said handlebar and said bottom defining said recess, a tubular portion extending from an under side of each one of two ends of said handlebar, each of said tubular portions having a first hole defined in an outer surface thereof, said bottom having a first stud extending upwardly from an upper surface thereof and having two second holes defined therein, each one of said second holes respectively communicating with said tubular portion corresponding thereto;

a bar having a second stud extending from an under side thereof and having a side wall extending downwardly from each one of two ends thereof, each of said side wall having a third hole defined therein, said bar being configured to be received in said recess of said handlebar and a resilient element urged between said first stud and said second stud;

two connecting elements each having a first end and a second end, said first end thereof having a fourth hole defined therein and being inserted through said second hole from said under side of said tubular portion corresponding thereto, said first end of said connecting element being fixedly disposed to said corresponding side wall of said bar by extending a first screw through said third hole and said fourth hole, said second end of said connecting element having a slot defined longitudinally therein, two bosses extending from said connecting element between which said slot is defined;

two first tubes each having a first end and a second end, and comprising an outer side and an inner side, an upper hole defined in said outer side of said first end of said first tube and a lower hole defined in said inner side of said second end of said first tube, each of said first tubes receiving said connecting element corresponding thereto and each of said first tubes being fixedly connected to said tubular portion corresponding thereto by extending a second screw through said first hole of said tubular portion and said upper hole of said first tube;

two second tubes each having a first end and a second end, and comprising an outer side and an inner side, a plurality of fifth holes defined longitudinally along said inner side of each of said second tubes and a locking hole defined in said outer side of said first end of each of said two second tubes, said second end of each one of said first tubes inserted into said first end of said second tube corresponding thereto;

a base having a bottom and a receiving portion extending from each one of two ends of said bottom of said base, said second end of each of said second tubes being fixedly received in said receiving portion corresponding thereto;

two locking members each having a shank and a head which extends radially from one end of said shank, said shank inserted through said lower hole of said corresponding first tube and one of said fifth holes of said corresponding second tube, and two resilient elements each disposed in said first tube corresponding thereto and having a first end and a second end, said first end thereof fixedly disposed in an inner surface of said outer side of said first tube and said second end thereof being fixed to said head such that when said bar is pushed downwardly toward to said locking member, each one of said locking members is lifted out from said locking hole by said bosses being moved below said head of said locking member corresponding thereto.

* * * * *